US010340096B2

(12) United States Patent
Yeckley

(10) Patent No.: US 10,340,096 B2
(45) Date of Patent: Jul. 2, 2019

(54) SYSTEM AND METHOD FOR AIR MOTOR RECHARGING OF SPRING MECHANISMS

(71) Applicant: MITSUBISHI ELECTRIC POWER PRODUCTS, INC., Warrendale, PA (US)

(72) Inventor: Russell N. Yeckley, Murrysville, PA (US)

(73) Assignee: MITSUBISHI ELECTRIC POWER PRODUCTS, INC., Warrendale, PA (US)

( * ) Notice: Subject to any disclaimer, the term of this patent is extended or adjusted under 35 U.S.C. 154(b) by 22 days.

(21) Appl. No.: 15/600,399

(22) Filed: May 19, 2017

(65) Prior Publication Data

US 2018/0337006 A1 Nov. 22, 2018

(51) Int. Cl.
*H01H 33/32* (2006.01)
*H01H 3/30* (2006.01)

(52) U.S. Cl.
CPC ..... *H01H 3/3026* (2013.01); *H01H 3/3021* (2013.01); *H01H 33/32* (2013.01)

(58) Field of Classification Search
CPC ..... H01H 71/24; H01H 71/08; H01H 71/10; H01H 2235/01; H01H 47/22; H01H 83/04; H01H 21/42; H01H 71/0207; H01H 71/2463; H01H 71/50; H01H 9/54; H01H 2300/03; H01H 31/006; H01H 33/66; H01H 47/002; H01H 71/02; H01H 71/025; H01H 71/04; H01H 71/58; H01H 75/04; H01H 13/023; H01H 13/06; H01H 13/14; H01H 19/64; H01H 1/0015; H01H 1/04;

(Continued)

(56) References Cited

U.S. PATENT DOCUMENTS 2,394,036 A 2/1946 Boden et al.
2,426,250 A * 8/1947 Taylor ..... H01H 33/7015 218/47

(Continued)

OTHER PUBLICATIONS

Heinemann, L., et al., "Technology Benchmark of Operating Mechanisms for High Voltage Switchgear," retrieved from https://library.e.abb.com/public/8e154db38cef63bbc1257857005a5e3b/ABB_HMB_Technical%20paper%20CEPSI%202010.pdf, 2010, pp. 1-8.

(Continued)

*Primary Examiner* — Truc T Nguyen
(74) *Attorney, Agent, or Firm* — One LLP

(57) ABSTRACT

A circuit breaker system having an electrical contact system, the electrical contact system includes one or more electrical contacts that are movable between a closed and an open position via a rechargeable spring loaded operating mechanism. An air motor recharging system includes an air motor operably coupled to the operating mechanism for recharging a closing spring. The air motor recharging system further comprises a solenoid valve that, when in an open position, supplies pressurized air to the air motor from a pressurized air storage tank at a preferred operating pressure sufficient to enable the air motor to drive a charging shaft and gear assembly to recharge a closing spring. The circuit breaker system further comprises an air compressor to delivers compressed air to the air storage tank to fill and maintain the storage tank at a preferred storage pressure.

11 Claims, 4 Drawing Sheets

Prior Art

(58) Field of Classification Search

CPC .... H01H 1/221; H01H 1/42; H01H 2009/343; H01H 2009/348; H01H 2033/566; H01H 2033/908; H01H 2071/042; H01H 2071/044; H01H 2071/2427; H01H 2071/665; H01H 2071/7481; H01H 2083/201; H01H 21/54; H01H 2205/002; H01H 2223/044; H01H 2235/016; H01H 2300/052; H01H 33/10; H01H 33/161; H01H 33/22; H01H 33/34; H01H 33/55; H01H 33/561; H01H 33/562; H01H 33/62; H01H 33/7015; H01H 33/73; H01H 33/74; H01H 33/75; H01H 33/82; H01H 33/84; H01H 33/91; H01H 33/92; H01H 3/3005; H01H 3/3026; H01H 3/38; H01H 3/42; H01H 3/46; H01H 50/045; H01H 50/16; H01H 50/18; H01H 50/32; H01H 50/36; H01H 50/644; H01H 51/29; H01H 55/00; H01H 69/00; H01H 71/00; H01H 71/0228; H01H 71/0264; H01H 71/1009; H01H 71/1018; H01H 71/1027; H01H 71/1081; H01H 71/12; H01H 71/125; H01H 71/32; H01H 71/465; H01H 71/501; H01H 71/505; H01H 71/526; H01H 71/56; H01H 71/66; H01H 71/68; H01H 71/74; H01H 71/7463; H01H 73/12; H01H 73/36; H01H 73/38; H01H 73/64; H01H 75/02; H01H 83/22; H01H 85/203; H01H 89/00; H01H 89/04; H01H 89/06; H01H 9/02; H01H 9/0264; H01H 9/16; H01H 9/161; H01H 9/168; H01H 9/24; H01H 9/34; H01H 9/342

See application file for complete search history.

(56) References Cited

U.S. PATENT DOCUMENTS

| | | | | | |
|---|---|---|---|---|---|
| 2,689,317 | A | | 9/1954 | Timmerman | |
| 2,730,589 | A | * | 1/1956 | Perry | H01H 33/34 200/82 B |
| 2,730,590 | A | | 1/1956 | Kelle | |
| 2,773,484 | A | * | 12/1956 | Peek | H01H 33/32 200/81.5 |
| 2,853,055 | A | * | 9/1958 | Perry | H01H 33/34 137/513 |
| 3,105,126 | A | * | 9/1963 | Peek | H01H 33/34 200/82 B |
| 3,174,022 | A | * | 3/1965 | Peek | H01H 3/30 200/400 |
| 3,177,324 | A | * | 4/1965 | Boehne | H01H 9/34 218/149 |
| 3,208,220 | A | * | 9/1965 | Lechat | H01H 33/34 60/371 |
| 3,333,077 | A | * | 7/1967 | Fish, Jr. | H01H 33/16 200/82 B |
| 3,457,530 | A | * | 7/1969 | Van Sickle | H01H 3/30 200/318 |
| 3,532,842 | A | * | 10/1970 | Fohrhaltz | H01H 3/42 200/83 C |
| 3,588,520 | A | * | 6/1971 | Barkan et al. | H01H 9/52 200/48 R |
| 3,662,135 | A | * | 5/1972 | Clark | H01H 33/55 218/123 |
| 3,812,306 | A | * | 5/1974 | Harris | H01H 43/026 200/19.2 |
| 3,967,132 | A | | 6/1976 | Takamine | |
| 4,213,030 | A | | 7/1980 | Takamine | |
| 4,461,937 | A | * | 7/1984 | Boni | H01H 33/34 200/82 B |
| 5,421,894 | A | | 6/1995 | Lei et al. | |
| 2014/0027408 | A1 | * | 1/2014 | Yang | H01H 33/66 218/118 |
| 2015/0091677 | A1 | * | 4/2015 | Urai | H01H 71/025 335/8 |
| 2015/0262767 | A1 | * | 9/2015 | Benke | H01H 9/24 200/50.27 |
| 2017/0047181 | A1 | * | 2/2017 | Yang | G01R 31/3277 |

OTHER PUBLICATIONS

"Electric motor (MCH)", Schneider Electric, retrieved from http://www2.schneider-electric.com/documents/electrical-distribution/en/shared/interactive-catalogue/lvped208004en/lvped208004en/pdfs/page_036.pdf on Aug. 28, 2017, 1 page.

* cited by examiner

SYSTEM AND METHOD FOR AIR MOTOR RECHARGING OF SPRING MECHANISMS

FIELD

The embodiments described herein relate generally to operating mechanisms for circuit breaker systems and methods, and more specifically to systems and methods for air motor recharging of spring mechanisms for operating high voltage circuit breakers.

BACKGROUND

A power circuit breaker or circuit interrupter can be divided into three major components: arc-interrupting and current-carrying contacts; entrance bushings; and an operating mechanism. Each of these components is vital to the operation of a circuit breaker; weakness in any one will result in unsuccessful breaker operation. After a circuit breaker has been placed in service, practical experience has shown that the operating mechanism requires the most attention.

The function of the operating mechanism is to open and close the breaker contacts. This, by itself, is a comparatively simple task. However, circuit breaker operating mechanisms are usually specified to meet at least the following design criteria: 1) allow contacts to open and then reclose once in a total maximum time of three to five 60 hz electrical cycles (0.05 to 0.08 seconds); and 2) perform at least five closing and opening operations without the energization of a prime mover.

Conventional spring loaded operating mechanisms for operating high voltage power circuit breakers, commonly known as a "stored energy mechanism," tend to use an electric motor to recharge the closing spring after each closing operation. An example of a conventional electric motor recharging spring loaded operating mechanism is depicted in FIG. 1. The arrangement of the mechanism drive linkage enables the closing spring to also charge the opening spring as part of the closing sequence. Without electric power and, thus without the availability of the electric recharging motor, these conventional operating mechanisms tend to limit breaker operation to an Open-Close-Open (O-C-O) cycle. This raises concerns surrounding conditions during loss of electricity. In the event that the electric motor is available for recharging the spring, such recharging time is specified to be 15 seconds, which results in the breaker operation being limited to an Open-Close-Open-15 second recharge-Close (O-C-O-15 sec-C).

Hydraulic storage systems have been explored for designs requiring breakers with 4 or 5 operations under conditions where power has been lost, or electricity is unavailable. A hydraulic accumulator is used to recharge the closing spring mechanism. By varying the size of the hydraulic accumulator, the desired number of stored operations can be achieved.

Attempts to meet the requirement of multiple operations using storage batteries or stand-by generators have been unsuccessful or operationally unacceptable.

It is within the aforementioned context that a need for improved spring mechanisms for operating high voltage power circuit breakers has arisen. Thus, there is a need to address one or more of the foregoing disadvantages of conventional systems and methods, and the embodiments presented herein meet this need.

SUMMARY

Various aspects of methods and systems for air motor recharging of spring mechanisms can be found in exemplary embodiments presented herein.

In certain embodiments, a circuit breaker system, comprises an electrical contact system, the electrical contact system includes one or more electrical contacts that are movable between a closed and an open position via a rechargeable spring loaded operating mechanism. The circuit breaker system further comprises an air motor recharging system for recharging a closing spring if or when the primary electric or hydraulic drive system within the operating mechanism is unavailable. An air motor within the recharging system is operably coupled to the operating mechanism and operably responsive to pressurized air supplied thereto for recharging the closing spring of the operating mechanism. The circuit breaker system further comprises a solenoid valve that, when in an open position, supplies compressed air to the air motor from a pressurized air storage tank according to a preferred operating pressure, the operating pressure supplying sufficient energy to the air motor to enable the air motor to drive a charging shaft and gear assembly to move the closing spring to a recharged position if or when necessary. A pressure regulator controls the pressure level of air delivered from air storage tank through the solenoid valve to the air motor. The circuit breaker system further comprises an air compressor that delivers compressed air to the air storage tank to maintain a preferred storage pressure, wherein air in the air storage tank is stored at a storage pressure controlled by a pressure control switch. Alternatively, since unavailability of the primary electric drive motor is rare, manual and/or occasional recharging of the air storage tank from a portable external source on an as-needed basis is feasible and/or practical.

Advantageously, the air motor based recharging system enables several closing operations by the operating system in the event of electric power loss. The number of available operations is only limited by the practical size of the air storage tank and the pressure of the air stored therein.

Other systems, methods, features and advantages of the example embodiments will be or will become apparent to one with skill in the art upon examination of the following figures and detailed description.

BRIEF DESCRIPTION

The details of the example embodiments, including fabrication, structure and operation, may be gleaned in part by study of the accompanying figures, in which like reference numerals refer to like parts. The components in the figures are not necessarily to scale, emphasis instead being placed upon illustrating the principles of the example embodiments. Moreover, all illustrations are intended to convey concepts, where relative sizes, shapes and other detailed attributes may be illustrated schematically rather than literally or precisely. In the drawings, the same reference numbers indicate identical or functionally similar elements FIG. 1 illustrates a conventional electric motor driven spring mechanism design.

It should be noted that elements of similar structures or functions are generally represented by like reference numerals for illustrative purpose throughout the figures. It should also be noted that the figures are only intended to facilitate the description of the preferred embodiments.

DETAILED DESCRIPTION

Each of the additional features and teachings disclosed below can be utilized separately or in conjunction with other features and teachings to produce an air motor recharging system and methods of spring mechanisms for operating high voltage circuit breakers. Representative examples of the present invention, which examples utilize many of these additional features and teachings both separately and in combination, will now be described in further detail with reference to the attached drawings. This detailed description is merely intended to teach a person of skill in the art further details for practicing preferred aspects of the present teachings and is not intended to limit the scope of the invention. Therefore, combinations of features and steps disclosed in the following detailed description may not be necessary to practice the invention in the broadest sense, and are instead taught merely to particularly describe representative examples of the present teachings.

Moreover, the various features of the representative examples and the dependent claims may be combined in ways that are not specifically and explicitly enumerated in order to provide additional useful embodiments of the present teachings. In addition, it is expressly noted that all features disclosed in the description and/or the claims are intended to be disclosed separately and independently from each other for the purpose of original disclosure, as well as for the purpose of restricting the claimed subject matter independent of the compositions of the features in the embodiments and/or the claims. It is also expressly noted that all value ranges or indications of groups of entities disclose every possible intermediate value or intermediate entity for the purpose of original disclosure, as well as for the purpose of restricting the claimed subject matter.

Figure 1:
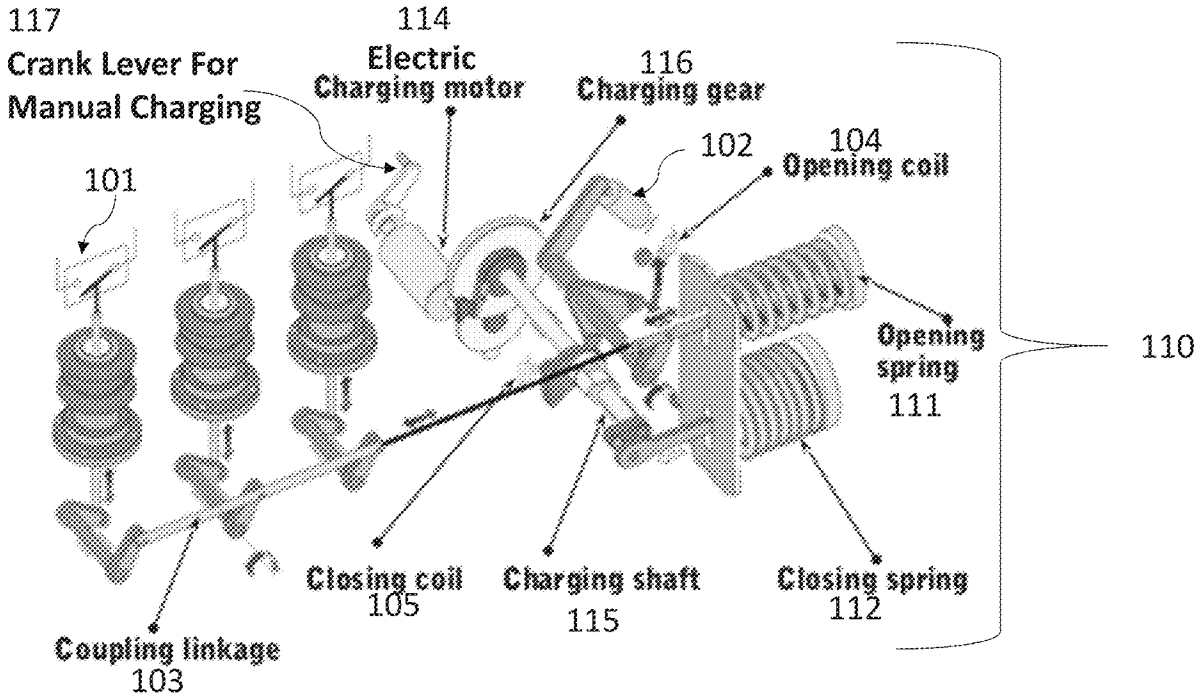
Prior Art FIG. 1

Turning to FIG. 1, a conventional spring-operated circuit breaker 110 employs mechanical springs to accumulate, store, and rapidly release energy to close and open the current-carrying contacts 101. FIG. 1 shows axially-compressed helical coil springs 112 and 111 to perform the closing and opening operations respectively, but Belleville plates, radially-wound coil springs or torsion bars, hydraulic accumulators, or other functionally equivalent energy-storing elements can be and often are utilized.

In its initial undisturbed state, the contacts 101 are open and both the closing and opening springs 112 and 111 within the operating mechanism are relaxed. When control power is applied with the circuit breaker in the initial undisturbed state, the circuit breaker control system detects the relaxed closing spring 112 and activates the electric charging motor 114. The motor is coupled through a speed-reducing charging gear 116 to rotate the charging shaft 115, which compresses (charges) the closing spring 112. The circuit breaker control system deactivates the charging motor when the closing spring 112 reaches full compression, and a mechanical latch locks the charging shaft 115 to hold the closing spring 112 in compression and store energy to operate the circuit breaker. Industry standards typically require the charging operation to be completed in 15 seconds or less.

When an electrical signal is received to close the circuit breaker 110, the breaker control system energizes the closing coil 105. The closing coil 105 releases the charging shaft latch, which allows the closing spring 112 to rapidly and unstoppably relax, which drives the operating mechanism linkage to close the circuit breaker contacts 101. The arrangement and functioning of the mechanism linkage diverts some of the energy released from the closing spring 112 to simultaneously compress the opening spring 111. Accordingly, the circuit breaker 110 is always inherently able to immediately and positively reopen anytime a closing operation has taken place.

If the circuit breaker 110 is not commanded to reopen immediately upon completion of a closing operation, the circuit breaker control system detects that the closing spring 112 is once again uncompressed, and reactivates the electric charging motor 114 to immediately recompress the closing spring 112. Since 1) the opening spring 111 became compressed as part of the initial closing operation, and 2) the closing spring 112 is immediately recompressed by the charging motor 114, and 3) a subsequent closing operation would recompress the opening spring 111 once again, a spring-operated circuit breaker 110 with both springs 112 and 111 fully compressed is capable of performing one rapid and uninterrupted opening-closing-opening (O-CO) sequence without additional action of or by the electric charging motor 114.

In certain situations, the circuit breaker 110 could be commanded to reopen immediately upon completion of a closing operation. The resulting action is referred to as a close-open (CO) sequence. Since the closing and immediate reopening would result in both the closing and opening springs 112 and 111 becoming uncompressed, the control system would react to immediately energize the electric charging motor 114 to perform another 15-second closing spring recharging cycle. Accordingly, a spring-operated circuit breaker 110 that starts out with both springs 112 and 111 uncompressed would be capable of performing (CO-15 sec-CO-15 sec-etc.) sequences indefinitely as long as electric power is available to operate the charging motor 114.

In some applications, it is desirable and/or necessary for power circuit breakers to have the capability for more than a single O-CO or CO sequence, and/or otherwise remain fully operational for an extended period of time in the absence of control power or inoperability of the electric charging motor 114. Typical industry standards require that enough energy be stored to perform three to five opening operations under such circumstances. Spring-operated breakers are typically undesirable and/or unusable for such applications.

Industry standards typically require that a hand crank 117 or functionally equivalent mechanical means be provided to manually operate the closing spring charging linkage and/or charge the spring system if electric control power is absent or the electric motor 114 is otherwise inoperable. This requires a human operator to interact with a circuit breaker 110 that is possibly and/or usually connected to an energized power grid, which is usually operationally undesirable and/or potentially unsafe.

Figure 2:
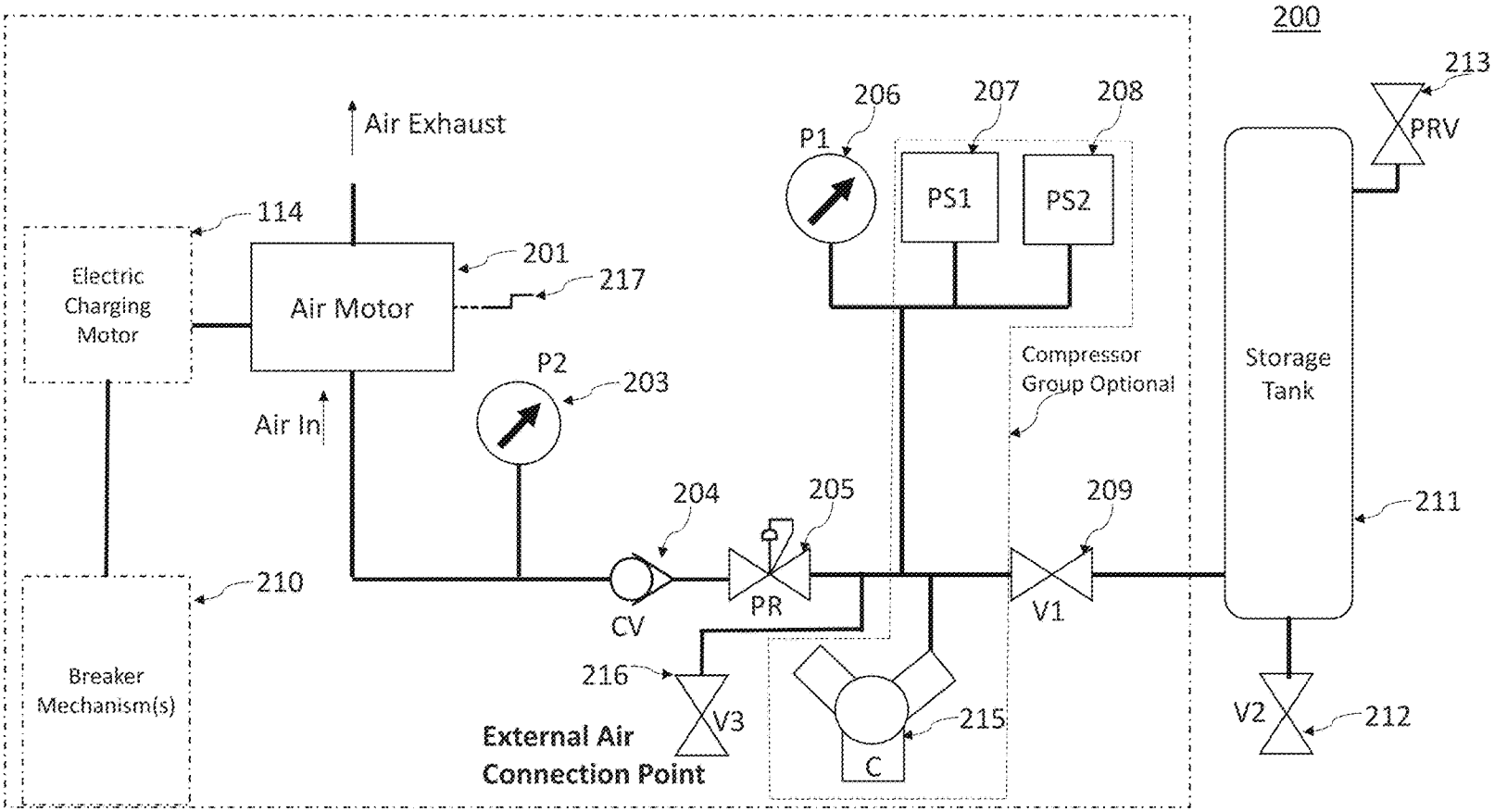
FIG. 2 illustrates an exemplary air motor recharging system according to embodiments of the present disclosure.
Figure 3:
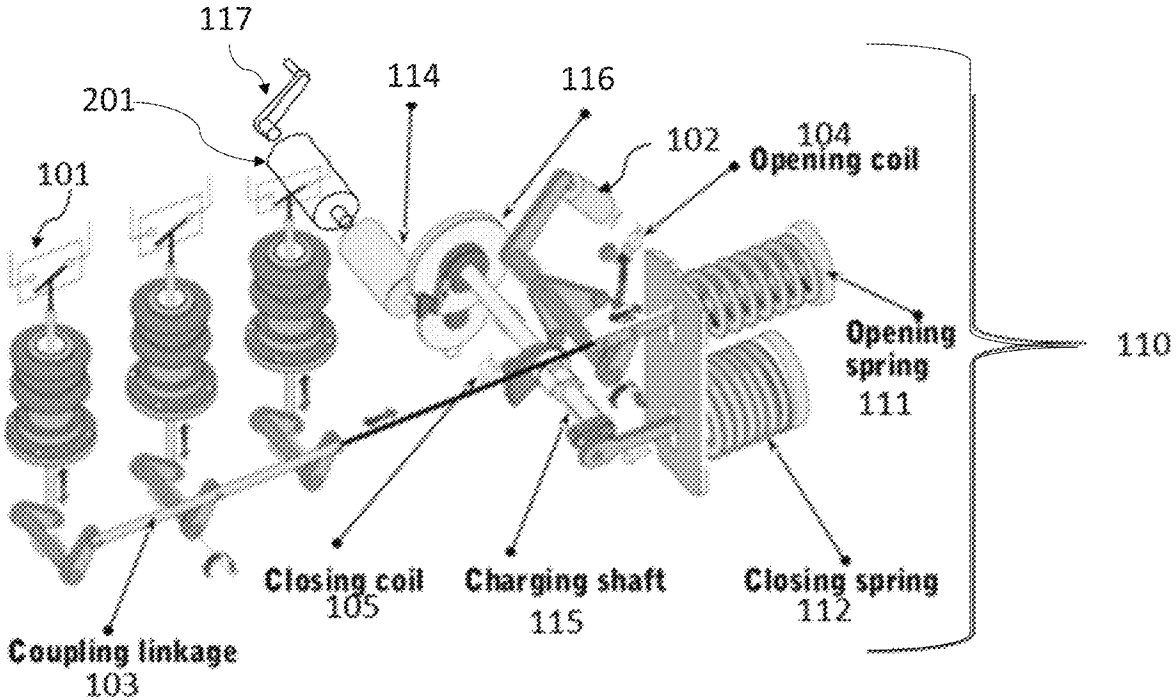
FIG. 3 illustrates an electric motor driven spring mechanism that has a conventional electric motor driven design and is retrofit with an air motor for an air motor recharging system.

FIG. 2 illustrates an exemplary air motor recharging system 200 according to the embodiments of the present disclosure to provide the capabilities detailed above. As depicted, the air motor recharging system 200 is couplable to a conventional spring-operated mechanism(s) 210 for opening and closing one or more contacts of one or more circuit breakers, and includes an air driven motor 202. As shown in FIG. 3, the air motor 201 is placed mechanically in series with the conventional electric charging motor 114, either in place of the manual crank charging lever 117, or in series between the manual crank 117 and the electric motor 202. The air driven motor 202 responds to pressurized air supplied to it in order to drive a recharging assembly of the breaker operating mechanism(s) 210 to charge or recharge the closing spring of the breaker operating mechanism(s) 210. The air driven motor 202 is preferably but not necessarily a rotational air-powered gear motor. It will be appreciated that breaker operating mechanism(s) 210 can be a single mechanism operating all three electrical contact pairs or a plurality of mechanisms operating each contact pair separately, and that each breaker mechanism and contact pair has an open and closed position.

When the solenoid valve 204 is in the open state, pressurized air is supplied to the air driven motor 202 from a pressurized air storage tank 211. Operating relays energize the solenoid to open the solenoid valve 204 when sensing circuits within the circuit breaker control system determine that it is appropriate and/or safe to do so. An operating pressure P2, measured by pressure gauge 203, is controlled or maintained at a predetermined level by a pressure regulator 205 interposing the solenoid valve 204 and the air storage tank 211. The operating pressure P2, in certain embodiments, is preferably maintained at, for example, about 80 psig.

A compressor 215 is provided to supply compressed air to fill and maintain the air storage tank 211 at a preferred storage pressure P1, which is measured by a storage pressure gauge 206. The storage pressure P1 is controlled by a pressure control switch 207. An alarm/lockout switch 208 provides a fail-safe for issues with compressed air. A shut off valve 209 is provided to isolate the storage tank 211 from the rest of the system.

A manual charging valve 216 provides a connection point for an external air source if the built-in air compressor 215 is non-functional. If operational circumstances allow the periodic and/or infrequent connection of an external air source to charge, recharge, or operate the air system, the compressor 215 as well as control switches 207 and 208 can be eliminated as a simplified and/or less costly alternative.

The storage tank 211 comprises a drain valve 212 and a pressure release valve 213. In certain embodiments, the stored air pressure P1 and volume of the storage tank 211 are fixed at, for example, about 175 psig and 60 gallons (8 cu. ft.) respectively. Both can be modified to suit specific needs to store more or less air, and correspondingly, provide more or fewer air-driven circuit breaker operations.

According to one embodiment, in compliance with common industry standards, the recharge time using the air motor 201 is 10 seconds, and the previously typified 60 gallon (8 cu.ft.) air storage tank 211 stores enough air to provide at least 5 Close-Open cycles of the breaker operating mechanism(s) 210 in the event that the electric spring charging motor 214 is unavailable.

Breaker operating mechanism(s) 210 can utilize energy-storing helical coil springs that are compressed radially when driven by the air motor 201. In other embodiments, breaker operating mechanism(s) can utilize radially-wound coil springs or torsion bars, Belleville plates, hydraulic accumulators, or other functionally equivalent energy-storing elements.

In some embodiments, system 200 is used in place of, coupled to, or as a backup system for a rotating electrical motor based system.

In other embodiments, air motors 202 can be used to drive rotating fluid pumps that typically power hydraulically-operated circuit breaker mechanisms. Such systems typically contain hydraulic accumulators that store energy to provide multiple circuit breaker operations, but using an air motor with a suitably sized air storage tank allows the accumulators to be significantly downsized or eliminated altogether.

Figure 4:
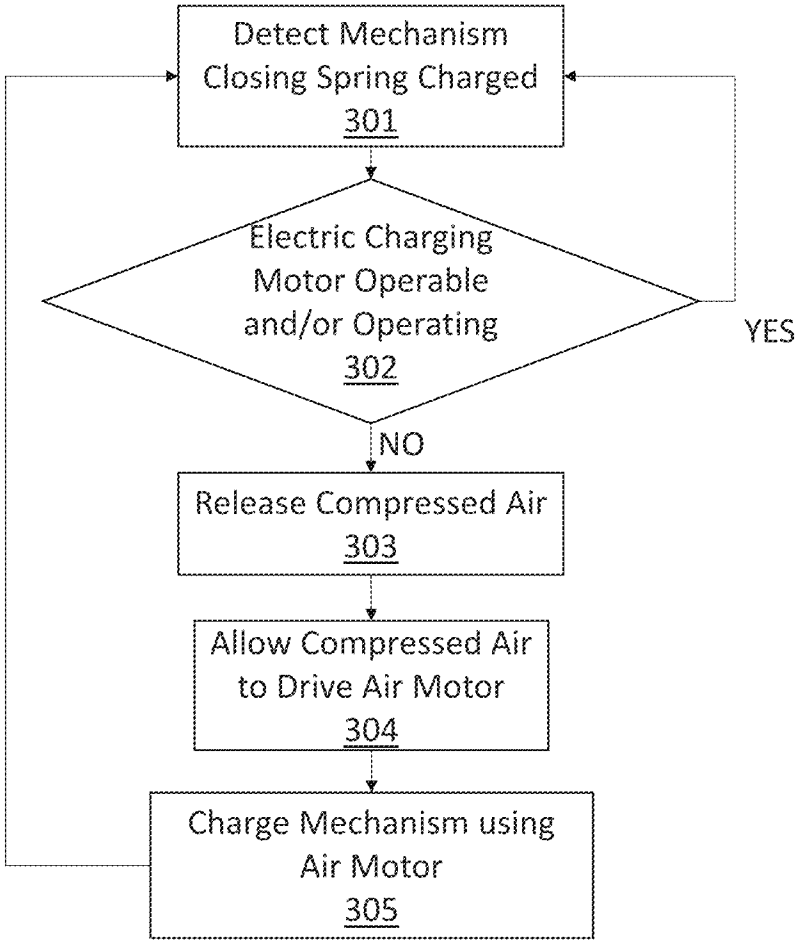
FIG. 4 illustrates an exemplary air motor recharging process according to embodiments of the present disclosure.

FIG. 4 illustrates an exemplary air motor recharging process 300 according to embodiments of the present disclosure.

In FIG. 4, upon detecting 301 that a circuit breaker operating mechanism is in its closed position, a state of the breaker mechanism is determined 302 to be one of charged or not charged.

If the state of the breaker mechanism is determined 302 to be not charged, compressed air is released 303 by activation of the solenoid valve 204. The pressurized air from the storage tank 211 is used to drive 304 the air motor 201 such that the air motor 201 can charge 305 the closing spring of the breaker operating mechanism 210.

Examples of air-powered gear motors suitable for use with the present disclosure include GAST® models 4AM-RV-75-GR20 and 4AM-RV-75-GR25. An example of a pressure regulator suitable for use with the present disclosure includes OMEGA® model R72G-2AK-RMN. An example of valves suitable for use with the present disclosure include ASCO® 2-way/2 position valves.

The air motor recharging system 200 according to the embodiments of the present disclosure, may be provided as an integrated part of a spring-operated spring loaded breaker operating mechanism, as an add-on accessory for standard production circuit breakers, and also for field retrofit applications on breakers previously manufactured.

In the foregoing specification, all features, elements, components, functions, and steps described with respect to any embodiment provided herein are intended to be freely combinable and substitutable with those from any other embodiment. If a certain feature, element, component, function, or step is described with respect to only one embodiment, then it should be understood that that feature, element, component, function, or step can be used with every other embodiment described herein unless explicitly stated otherwise. This paragraph therefore serves as antecedent basis and written support for the introduction of claims, at any time, that combine features, elements, components, functions, and steps from different embodiments, or that substitute features, elements, components, functions, and steps from one embodiment with those of another, even if the following description does not explicitly state, in a particular instance, that such combinations or substitutions are possible. Express recitation of every possible combination and substitution is overly burdensome, especially given that the permissibility of each and every such combination and substitution will be readily recognized by those of ordinary skill in the art upon reading this description.

In many instances entities are described herein as being coupled to other entities. It should be understood that the terms "coupled" and "connected" (or any of their forms) are used interchangeably herein and, in both cases, are generic to the direct coupling of two entities (without any non-negligible intervening entities) and the indirect coupling of two entities (with one or more non-negligible intervening entities). Where entities are shown as being directly coupled together, or described as coupled together without description of any intervening entity, it should be understood that those entities can be indirectly coupled together as well unless the context clearly dictates otherwise.

While the above is a complete description of exemplary specific embodiments of the invention, additional embodiments are also possible. Thus, the above description should not be taken as limiting the scope of the invention, which is defined by the appended claims along with their full scope of equivalents.

What is claimed is:

1. A circuit breaker system, comprising:

an electrical contact mechanism, the electrical contact mechanism movable between a closed and an open position;

an air motor, the air motor operable responsive to pressurized air supplied thereto for recharging the electrical contact mechanism following a closing operation;

an air storage tank that delivers pressurized air to the air motor, wherein air in the air storage tank is stored at a predetermined storage pressure;

a solenoid valve interposing the air motor and the air storage tank and energizable to an open state to enable pressurized air to flow to the air motor; and a pressure regulator interposing the solenoid valve and the air storage tank to control an operating pressure of the air delivered to the air motor at a predetermined pressure level, wherein the operating pressure supplying sufficient energy to the air motor to recharge the electrical contact mechanism.

2. The circuit breaker system of claim 1, wherein the electrical contact mechanism comprises:

one or more electrical contacts; and an operating mechanism, wherein the operating mechanism includes an opening spring;

a closing spring;

a coupling linkage operably coupled to the opening and closing springs and the one or more electrical contacts; and a recharging assembly coupled to the closing spring, wherein the air motor is operably coupled to the recharging assembly.

3. The circuit breaker system of claim 1, wherein the operating pressure is one of different from the storage pressure or equivalent to the storage pressure.

4. The circuit breaker system of claim 1, wherein the storage pressure is controlled by a pressure control switch.

5. The circuit breaker system of claim 1, further comprising an alarm/lockout switch.

6. The circuit breaker of claim 1, wherein the operating pressure is adjustable.

7. The circuit breaker system of claim 1, wherein the electrical contact mechanism includes an energy storing mechanical spring.

8. A circuit breaker comprising:

an arc-interrupting and current-carrying contact; and an operating mechanism, wherein the operating mechanism includes:

an opening spring;

a closing spring;

a coupling linkage operably coupled to the opening and closing spring and the arc-interrupting and current-carrying contact; and an air motor recharging system operably coupled to the closing spring to recharge the closing spring following a closing operation of the operating mechanism, wherein the air motor recharging system comprises:

an air motor;

an air storage tank in fluid communication with the air motor to supply pressurized air to the air motor;

a solenoid valve interposing the air motor and the air storage tank to control the flow of pressurized air from the storage tank to the air motor; and a pressure regulator interposing the solenoid valve and the air storage tank to control the pressure level of the pressurized air flowing from the storage tank to the air motor.

9. The circuit breaker of claim 8 wherein the air motor recharging system further comprises an air compressor in fluid communication with the air storage tank to fill the storage tank with pressurized air and maintain the pressure of the stored air at a predetermined pressure level.

10. The circuit breaker of claim 8, wherein the operating pressure is one of different from the storage pressure or equivalent to the storage pressure.

11. The circuit breaker of claim 8, wherein the storage pressure is controlled by a pressure control switch.

* * * * *